US010239028B2

(12) United States Patent
Smith et al.

(10) Patent No.: US 10,239,028 B2
(45) Date of Patent: Mar. 26, 2019

(54) BOUNDARY LAYER DRUM MIXER

(71) Applicants: Jonathan William Smith, Nepean (CA); Matthew William Smith, Algonquin (CA); Hugh Hunter Chant, Lyn (CA)

(72) Inventors: Jonathan William Smith, Nepean (CA); Matthew William Smith, Algonquin (CA); Hugh Hunter Chant, Lyn (CA)

( * ) Notice: Subject to any disclaimer, the term of this patent is extended or adjusted under 35 U.S.C. 154(b) by 195 days.

(21) Appl. No.: 15/278,336

(22) Filed: Sep. 28, 2016

(65) Prior Publication Data

US 2017/0095781 A1 Apr. 6, 2017

Related U.S. Application Data

(60) Provisional application No. 62/236,214, filed on Oct. 2, 2015.

(51) Int. Cl.

| | |
|---|---|
| ***B01F 3/08*** | (2006.01) |
| ***B01F 5/10*** | (2006.01) |
| ***B01F 7/00*** | (2006.01) |
| ***B01F 7/22*** | (2006.01) |

(52) U.S. Cl.

CPC ..... *B01F 7/225* (2013.01); *B01F 3/0857* (2013.01); *B01F 5/104* (2013.01); *B01F 7/0075* (2013.01); *B01F 7/00358* (2013.01); *B01F 7/00633* (2013.01); *B01F 7/22* (2013.01)

(58) Field of Classification Search

CPC ..... B01F 3/0857; B01F 5/104; B01F 5/106; B01F 7/00358; B01F 7/00633; B01F 7/00733; B01F 7/0075; B01F 7/22; B01F 7/225

See application file for complete search history.

(56) References Cited

U.S. PATENT DOCUMENTS

| | | | | | |
|---|---|---|---|---|---|
| 4,329,069 | A * | 5/1982 | Graham | B01F 5/12 | 366/270 |
| 4,449,826 | A * | 5/1984 | Mathis | B01F 7/00708 | 366/104 |
| 5,478,147 | A * | 12/1995 | O'Brien | B01F 3/1221 | 366/157.4 |
| 5,711,902 | A * | 1/1998 | Hsu | B01F 3/04609 | 261/91 |
| 7,029,162 | B2 * | 4/2006 | Villwock | B01D 19/0063 | 366/139 |
| 2004/0042942 | A1 * | 3/2004 | Siccardi, Jr. | B01F 7/225 | 422/209 |

* cited by examiner

*Primary Examiner* — Ryan A Reis

(57) ABSTRACT

The boundary layer drum mixer is an apparatus which can pass through the narrow top port of a standard chemical drum or bulk container without the need to disassemble any part of the mixer or the vessel. The invention is an enclosed system with an internal arrangement of impellers and stators which draw liquid-based media from the adjacent vessel and strategically distributes it throughout the vessel through an array of outlet ports. The strategic mixing requires low energy input, minimizes the risk of media aeration and works with a wide range of fluid levels. The apparatus imparts no net external torque, and therefore, requires no rigid mounting. The upper impeller flow positively entrains particles or liquid phases that tend to float. The lower impeller flow positively entrains particles or liquid phases that tend to sink and/or remain static in boundary layers against or near the vessel walls and base.

3 Claims, 1 Drawing Sheet

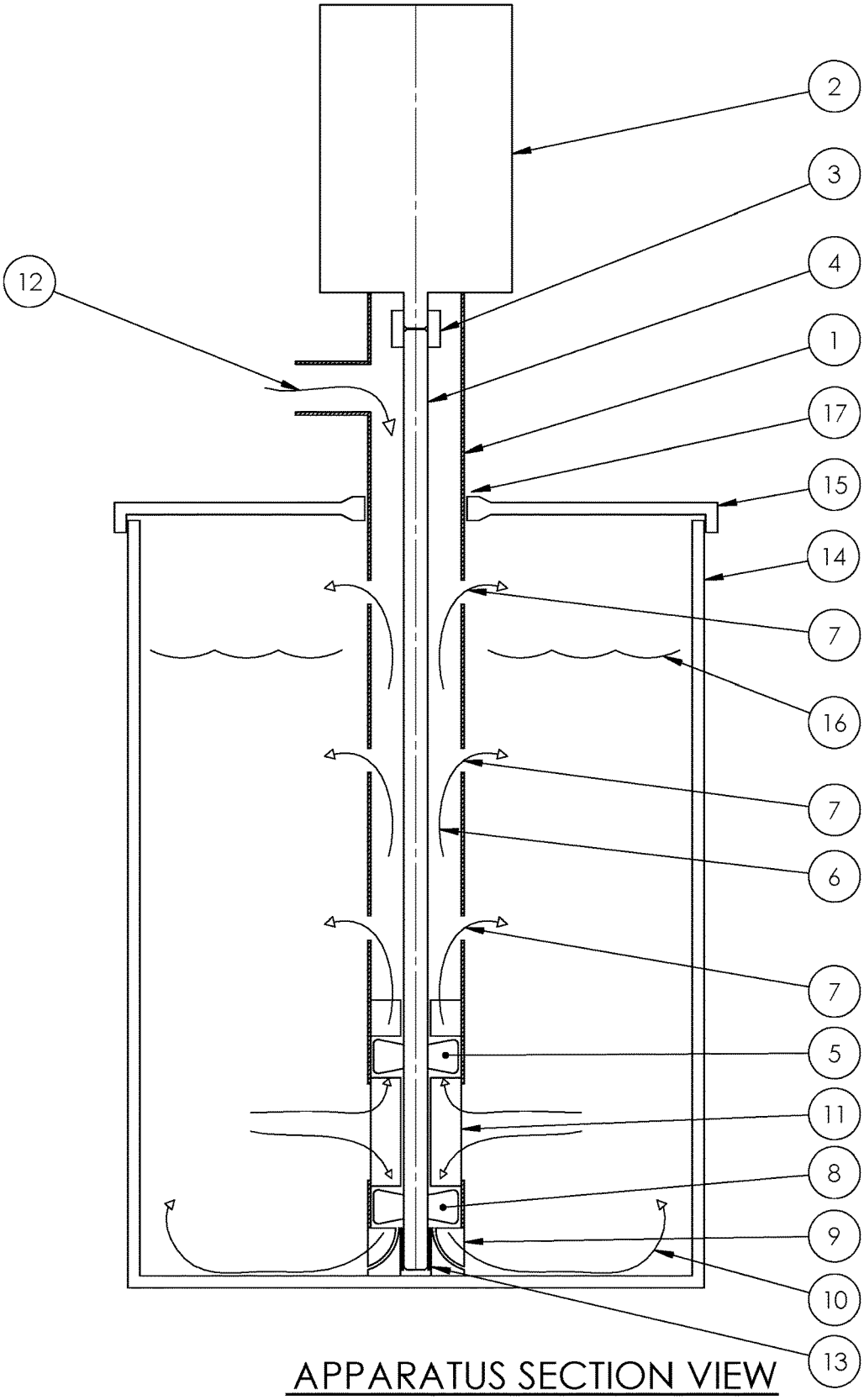
APPARATUS SECTION VIEW

BOUNDARY LAYER DRUM MIXER

CROSS-REFERENCE TO RELATED APPLICATION

Not Applicable

BACKGROUND OF INVENTION

This invention pertains to enclosed or partially enclosed vessels containing solutions or mechanical mixtures which are required to be blended, either continuously or intermittently. This is a very common need in a wide range of industries which includes the storage, mixing, processing and decanting of food products, pharmaceutical products and general chemical products of many types. These products are typically stored and transported in metal or plastic drums or bulk containers which have relatively small access ports on their top surface or on their lids, if applicable. There exists a need for an enclosed style mixer which can fit through these small ports without disassembly of the mixer or disassembly of the vessel lid. Further, there exists a need for a mixer apparatus that can effectively and efficiently blend the liquid-based contents throughout the volume of the vessel with the ability to entrain particles or liquid phases which tend to float, tend to sink or tend to remain static in the boundary layer against or near the vessel's inner walls or inner base.

The industry widely relies on an open-impeller type mixer design. This typically comprises a rigidly mounted motor or frame with a spinning shaft and impeller arrangement.

This existing technology fails to meet the full performance of the present invention for any or all of the following reasons: Open impeller mixers are required to be disassembled or are required to have collapsible impellers in order to pass through standard vessel ports. Open impeller mixers can physically damage vessels or vessel liners and may create sparking which presents risks in explosive environments. Open impeller mixers tend to cause rotation of the liquid media in the drum which causes aeration of the media and limits the mixing performance. Open impeller mixers cannot induce efficient flow at the boundary layers where the liquid media contacts the vessel interior base and interior walls. Open impeller mixers impart a reactive torque through their static frame elements, which must be restrained by means of bulky and cumbersome bracketry. Open impeller mixers require an excess of energy in order to impart mixing throughout large vessel volumes because the mixing is induced from a centralized point at the impeller with no strategic ducted distribution of media. Open impeller mixers are typically set in a fixed position which cannot reach the liquid media at low levels in the vessel, or will cause excessive aeration of the media once at low levels in the vessel.

BRIEF SUMMARY OF THE INVENTION

The subject invention is a mechanical mixer which allows for efficient and thorough mixing of media with minimal consumption of energy and minimal aeration of the liquid media. The mixer is of a completely enclosed design which requires neither the disassembly of the vessel nor disassembly of the mixer itself in order to introduce the mixer to, or to remove the mixer from, the narrow port in the top of the vessel. The mixer uses a strategic ducting of liquid through its tubular frame to strategically distribute the media throughout the vessel, while adequately reaching the complete internal volume of the vessel, including the media-atmospheric interface at the top, the interior vessel walls and the interior vessel base. The enclosed mixer design has no net external rotational torque, so it can be free standing with no need for rigid mounting, which simplifies relocation of the mixer between vessels.

BRIEF DESCRIPTION OF DRAWING VIEWS

FIG. 1: APPARATUS SECTION VIEW
(Cross sectional representation of the Boundary Layer Drum Mixer)

DETAILED DESCRIPTION OF THE INVENTION

Referring now in detail to FIG. 1 (apparatus section view), numbered features are described as follows: 1 is a tubular shaped housing which acts as a structural frame for the apparatus and acts as a duct for channeling and distributing liquid media. 2 is a motor used to induce a rotation to an attached shaft coupler. 3 is a shaft coupler used to induce a rotation to an attached drive shaft. 4 is a drive shaft used to induce a rotation to multiple arrays of impellers. 5 is an upper rotating impeller and static stator assembly which induces an upward axial flow of liquid media through the tubular housing. 6 is the upward flow of liquid media within the tubular housing. 7 is an array of outlet ports by which liquid media is disbursed from within the tubular housing to the volume outside the housing to the adjacent vessel. 8 is a lower rotating impeller and static stator assembly which induces a radial flow of liquid media outwardly from the annular array of outlet ports on the tubular housing to the volume outside the housing. 9 is the annular array of lower outlet ports. 10 is the radial liquid media flow adhering to the base of the adjacent container to entrain settled media in the boundary layer. 11 is an array of inlet ports and stator assemblies at a central location to introduce liquid media to the upper and lower impeller and stator assemblies. 12 is a media introduction port at the top of the housing for a return line connection for adding new or recirculated liquid media to the adjacent vessel directly through the mixer tubular housing from an adjacent pipe or hose. 13 is the lower bearing assembly to provide radial support to the drive shaft. 14 is the adjacent vessel to contain the media being mixed. 15 is the lid of the adjacent vessel. 16 represents an example fluid level of the media being mixed. 17 is a standard drum port through which the mixer assembly is installed and by which the assembly is supported radially.

The apparatus can be constructed with varying geometry to accommodate vessels of different shapes and sizes. The specific quantity, size and geometry of the outlet port arrays can be varied to accommodate media of different constituents and fluid characteristics. The apparatus can be made to operate using a motor powered by either electrical energy, or compressed air energy, or hydraulic fluid energy.

The materials of construction of the apparatus are not restricted, provided that they are structurally sturdy enough to perform as intended, and compatible with their environment.

The invention claimed is:

1. A boundary layer drum mixer comprising:
a rotating motor; and
a rotor assembly comprising:
a shaft coupler; and
a shaft; and an upper impeller; and
a lower impeller; and
a stator assembly comprising:
a tubular housing; and
an upper stator vane array; and
a lower stator vane array; and
an inlet stator vane array; and
a media introduction port; and
an array of inlet ports; and
an array of outlet ports; and
a lower radial friction bearing; and
an adjacent vessel comprising:
a rigid enclosure with sealed sides and bottom; and
an affixed or removable lid; and
an access port through the top of the vessel or lid; and
a liquid-based media;

wherein the rotating motor imparts rotational motion and energy to the rotor assembly, inducing liquid-based media from the adjacent vessel to be drawn into the media inlet ports, propelled through the impeller and stator arrangements, propelled through the tubular housing, propelled through the array of outlet ports and distributed throughout the liquid media in the adjacent vessel;

wherein an upward flow of liquid-based media being propelled by the upper impeller and stator arrangement is delivered via the tubular housing to an array of upper outlet ports for distribution throughout the adjacent vessel for rapid and positive mixing and for entrainment of particles or liquid phases which tend to float at the top of the vessel.

2. The boundary layer drum mixer from claim 1, wherein a downward flow of liquid-based media being propelled by the lower impeller and stator arrangement is ejected radially from the mixer apparatus for distribution into the base of the vessel, and to cause rapid and positive mixing of particles and liquid phases settled in the boundary layer at or near the inner vessel base and inner vessel walls.

3. The boundary layer drum mixer from claim 1, wherein liquid media from an external pipe or hose can be introduced into the vessel through the body of the mixer apparatus via the integral media introduction port.

* * * * *